United States Patent [19]

Jandeska, Jr.

[11] 4,430,295

[45] Feb. 7, 1984

[54] ARTICLES PRODUCED FROM IRON POWDER COMPACTS CONTAINING HYPEREUTECTIC COPPER PHOSPHIDE POWDER

[75] Inventor: William F. Jandeska, Jr., Rochester, Mich.

[73] Assignee: General Motors Corporation, Detroit, Mich.

[21] Appl. No.: 322,868

[22] Filed: Nov. 19, 1981

Related U.S. Application Data

[63] Continuation of Ser. No. 139,102, Apr. 10, 1980, abandoned.

[51] Int. Cl.[3] ..... B22F 3/00

[52] U.S. Cl. ..... 419/46; 419/47; 428/567

[58] Field of Search ..... 75/200, 221; 419/46, 419/47; 428/567

[56] References Cited

U.S. PATENT DOCUMENTS

| | | | |
|---|---|---|---|
| 2,213,523 | 9/1940 | Jones et al. | 75/221 |
| 2,226,520 | 12/1940 | Lenel | 75/221 |
| 3,674,472 | 7/1972 | Kimura et al. | 75/221 |

OTHER PUBLICATIONS

Jones, Fundamental Principles of Powder Metallurgy 1960, pp. 504, 505, 508, 509.

Bockstiegel et al., "Influence of Various Alloying Additions on Case Hardening of Sintered Steel Parts", by Hoganas Presented 9-66 in Czechoslovakia.

*Primary Examiner*—Brooks H. Hunt

*Attorney, Agent, or Firm*—Douglas D. Fekete

[57] ABSTRACT

In the preferred embodiment, a method is presented for forming an iron-base article by powder metallurgy, which includes compacting a powder mixture comprising a major portion of iron particles and between about 2 to about 5 weight percent of a powder consisting of hypereutectic tricopper phosphide $Cu_3P$ compound. The compact is sintered at a temperature between about 970° C. to about 1100° C., whereupon the copper phosphide forms a liquid that flows and wets the iron particle surfaces. During sintering, phosphorus from the copper phosphide diffuses into the iron particles and resulting copper-enriched liquid forms a film coating pore surfaces in the compact. The sintered article displays an improved combination of ductility and strength, particularly in view of the relatively low sintering temperature.

5 Claims, No Drawings

ARTICLES PRODUCED FROM IRON POWDER COMPACTS CONTAINING HYPEREUTECTIC COPPER PHOSPHIDE POWDER

This is a continuation of application Ser. No. 139,102, filed Apr. 10, 1980, now abandoned.

BACKGROUND OF THE INVENTION

This invention relates to manufacturing an article by powder metallurgy comprising compacting and sintering a mixture of iron powder and hypereutectic copper phosphide powder. More particularly, this invention relates to sintering a green compact comprising iron powder and copper phosphide powder at an relatively low temperature to produce an iron-base article having improved mechanical properties.

In the powder metallurgy art, iron articles are typically produced by compacting iron powder and sintering the green compact by heating in a furnace at a temperature between about 1120° C. to 1200° C. for approximately one-half hour. Under these conditions, it is estimated that sintering utilizes up to about 70% of the total energy required to manufacture the article. It is also estimated that a decrease of as little as 100° C. in the sintering temperature would reduce energy usage more than 20% and also lower the cost of furnace maintenance by as much as half. Despite this economic incentive, the high sintering temperatures are required to produce articles having acceptable mechanical properties, particularly strength and ductility.

In addition to the sintering temperature, the mechanical properties are also substantially affected by the composition of the green compact. Plain iron powder alone produces a sintered article having good ductility, but limited strength. One method for improving product strength comprises admixing a powder containing an effective alloying agent with the iron powder prior to compacting and sintering. For example, small amounts of iron phosphide $Fe_3P$ powder are commonly added to plain iron powder. During sintering, the phosphorus diffuses throughout the iron compact, forming a hardened ferrite alloy and thereby strengthening the product. However, sintering temperatures of 1100° C. or higher are necessary to achieve significant strengthening within reasonable furnace times on the order of one-half hour. Even a small decrease in the sintering temperature results in a substantial reduction in these mechanical properties. Thus, the phosphorus-alloying sintering temperatures are comparable to those of iron alone. In addition, iron compositions containing phosphorus or other strengthening agents exhibit significantly reduced ductility in comparison to plain iron. Thus, the powder metallurgical art has long sought agents for admixing with plain iron powder to produce articles having an optimum combination of mechanical properties, that is, acceptably high strength and acceptably high ductility.

Therefore, it is an object of this invention to provide a powder metallurgical method for forming an iron article by mixing plain iron powder and a minor portion of an additive powder, which additive powder is a hypereutectic copper phosphorus composition, compacting the mixture and sintering to produce the article having improved mechanical properties, particularly in view of the sintering temperature. The product article features phosphorus distributed in the iron grains to improve strength and a copper-rich residue coating the pore surfaces, which also enhances product strength and ductility.

It is an object of one aspect of this invention to provide a method for forming an iron article by compacting a plain iron powder mixture containing a minor portion of a powder having a hypereutectic copper phosphorus composition and sintering the compact at an relatively lower temperature to diffuse phosphorus into the iron and form a copper-rich residue on the pore surfaces. The product article exhibits an acceptable combination of ductility and strength, comparable to conventional powdered iron articles sintered at significantly higher temperatures. More particularly, the method provides improved strength, such as conventionally achieved by iron phosphide addition, but at a significantly lower temperature.

In another aspect, it is an object of this invention to provide a method for forming an improved iron article by compacting a mixture comprising a major portion of plain iron powder and a minor portion of a hypereutectic copper phosphorus powder, and sintering. The product article exhibits improved mechanical properties, particularly strength, in comparison to conventional powdered iron articles sintered at equivalent temperatures, such as a plain iron product or a comparable iron phosphorus derived product.

SUMMARY OF THE INVENTION

In accordance with the preferred embodiment, these and other objects are accomplished by forming an iron-base article by compacting and sintering the mixture comprising a major portion of plain iron powder and an effective amount of a powder composed of intermetallic tricopper phosphide compound $Cu_3P$. About 2.0 to about 5.0 weight percent finely milled $Cu_3P$ particles are uniformly blended with a coarser grade powder of plain iron containing substantially no phosphorus or carbon. The resulting phosphorus concentration in the powder mixture—and thereby in the product article—is thus between about 0.3 to about 0.7% by weight. The metal powders are mixed with a small amount of zinc stearate lubricant, filled into a suitably shaped die and compressed to form a green compact having a density of about 7.0 grams per cc. It has been found that the compressibility of the powder mixture is not significantly reduced by the copper phosphide addition. Thus, the green compact is readily compressed to a suitably high density capable of producing an acceptable density in the sintered article. The green compact is sintered by heating for about one-half hour in a reducing atmosphere at a temperature between about 970° C. to about 1100° C. or higher. During sintering, phosphorus diffuses from the copper phosphide into the iron particles and hardens the ferrite. Copper also diffuses into the iron particles, but at a substantially slower rate than the phosphorus and principally only along the grain boundaries. Most of the copper forms a liquid that wets the iron particle surfaces. This liquid thereafter solidifies to form a copper-rich film that coats the pore surfaces in the compact and, of particular significance here, blunts the microscopic cusps and thickens the neck regions between iron particles. Sintering is carried out for a time at least sufficient for the phosphorus to become substantially evenly distributed throughout the iron. After sintering, the article exhibits improved strength as the result of phosphorus, and to a much lesser extent, copper, in the ferrite. In addition, the copper-rich layer that coats the pores increases ductility as well as strength in the article. The effects combine to provide a finished article having significantly improved mechanical properties.

It is a significant feature of this invention that the preferred sintering range extends as low as 970° C., significantly lower than the $Cu_3P$ melting point of about 1014° C. or the metallic copper melting point of 1084.5° C. While not wishing to be limited to any particular theory, it is believed that the substantially greater affinity of phosphorus for iron rather than copper results in solid state diffusion of the phosphorus from the copper phosphide particles into contacting iron surfaces during sintering. $Cu_3P$ is an intermetallic compound theoretically containing 14.0 weight percent phosphorus. However, copper and phosphorus also form a low melting eutectic composition having a phosphorus content of about 8.4 weight percent and a melting point of about 714° C. As the result of the solid state phosphorus diffusion, the copper phosphorus composition adjacent the iron particles surfaces is locally shifted toward the eutectic. This causes the copper phosphorus to partially liquify. The resulting liquid readily wets the iron and enhances the phosphorus diffusion. As the rapid phosphorus diffusion continues, additional phosphide material liquifies, until all has melted and formed the copper-enriched liquid wetting the iron surfaces. Continued phosphorus diffusion thereafter lowers the liquid phosphorus concentration below the eutectic composition and eventually to a sufficiently low level to cause the copper-rich layer to solidify. For example, at a sintering temperature of about 1000° C., the copper alloy film remains at least partially fluid until the phosphorus concentration has dropped below about one-half percent. Thus, the copper-rich layer forms, coats the compact pores, and solidifies while still at sintering temperature. The copper phosphorus liquid formation in this method presents advantages similar to conventional liquid phase sintering. However, in comparison to liquid phase sintering, this method provides only a small volume of liquid that forms for only a short time during sintering and automatically solidifies at the sintering temperature.

Although it is theoretically possible to form the transient liquid at temperatures as low as the 714° C. eutectic melting point, such low temperatures do not produce suitable iron bonding within a reasonable time. However, the improvement in the mechanical properties resulting from the phosphorus-strengthening and the transient liquid formation are readily observable at temperatures as low as 950° C. In a particularly advantageous embodiment of this invention, sintering of the compact containing $Cu_3P$ powder is carried out at a temperature of about 1000° C. or lower to produce an article comparable in strength and ductility to intermediate-strength iron powder articles sintered at conventional temperatures of 1100° C. or greater.

At the preferred sintering temperatures, improved mechanical properties are obtained when the copper-rich liquid phase is present for sufficient time to flow and wet the iron surfaces. Copper phosphorus compositions having less than the eutectic phosphorus concentration apparently freeze before flowing and do not improve mechanical properties as desired. Suitable copper phosphorus compositions comprise hypereutectic concentrations of phosphorus, preferably greater than about 12%. The stable intermetallic compound $Cu_3P$ is most preferred. Compositions substantially richer in phosphorus than the $Cu_3P$ compound decompose upon heating to release phosphorus vapors and to thereby form $Cu_3P$ compound. Thus, these rich compositions are not preferred, but may yield suitable results.

The articles produced by this method exhibit improved mechanical properties, particularly strength and ductility. The absolute value for the product strength and ductility, conventionally measured as tensile yield strength and total elongation respectively, is directly related to both the sintering temperature and the copper phosphide addition. In general, for a particular sintering temperature, increasing the copper phosphide content in the compact increases the tensile yield strength at some sacrifice in elongation. For a particular copper phosphide content, increasing the sintering temperature generally improves both elongation and tensile yield strength, although this improvement tends to be less significant at higher copper phosphide levels. The unexpectedly high strengths and ductilities derived with the copper phosphide powder are readily observable by comparison to simple intermediate-strength powder metal products formed of iron alone or iron strengthened with a comparable phosphorus level. For sintering temperatures between about 1000°-1100° C., the $Cu_3P$ addition substantially improves tensile yield strength over either the plain iron article or the phosphide-strengthened article. Most surprisingly, the article produced with copper phosphide powder and sintered at 1000° C. evidences a yield strength greater than that of a comparable article formed from a mixture containing iron phosphide and sintered at 1100° C., despite the 100° difference in sintering temperature. Although within the preferred sintering temperature range, the ductility of the article formed with copper phosphide powder is less than that of similar plain iron articles, it is generally better than or equal to phosphide-strengthened articles. Thus, this invention provides a method either for improving the mechanical properties of a powder iron article when sintered at a particular temperature, or for producing comparable mechanical properties in a product sintered at a significantly lower temperature.

DETAILED DESCRIPTION OF THE INVENTION

Iron-base articles were manufactured in accordance with the method of this invention by compacting and sintering a homogeneous mixture of plain iron powder and a powder consisting essentially of the intermetallic compound $Cu_3P$. In this embodiment, the articles were flat unmachined tension test bars for laboratory tests. It is apparent that the method may be readily adapted to manufacture gears or other suitable workpieces.

The copper phosphide material was commercially available in the form of relatively large shot particles of the type generally employed for deoxidizing copper-base castings. The metallic grey material is substantially composed of the intermetallic compound $Cu_3P$. $Cu_3P$ is extremely brittle so that the shot was readily fragmented using a hammer mill to form the desired powder. The powder was sized to −325 mesh. Chemical analysis of the foundry-grade alloy showed it contained, by weight, 0.59 percent iron, 0.5 percent silicon, 0.01 percent manganese, 14.3 percent phosphorus and 82.9 percent copper, the balance being unknown. Thus, the weight ratio of copper to phosphorus was about 5.8, which was slightly richer in phosphorus than the theoretical 6.15 weight ratio of $Cu_3P$. Upon heating the copper phosphide powder commenced melting at about 1014° C.

A low-carbon grade iron powder was employed. The preferred powder was commercially obtained from the Hoeganaes Corporation under the trade designation Ancorsteel 1000B and reportedly contained a maximum carbon content of 0.01 weight percent and a maximum phosphorus content of 0.01 weight percent. The powder size was −60 mesh.

The copper phosphide powder and the plain iron powder were blended to form a series of uniform mixtures containing between about 2 to about 5 weight percent copper phosphide powder. In addition, about 0.75 weight percent zinc stearate was added for die lubrication and reduced press ejection pressures. The test bars were manufactured by placing an appropriate amount of the powder mixture into a die assembly having the desired flat dumbell shape. Using a hydraulic press, the powder in the die was compressed with a force of about 827 MPa to form a green compact having a density of 7.0 g/cc. The self-sustaining green compact was removed from the die and was ready for sintering.

The green compact was sintered in a box-like retort having a controlled atmosphere of slowly, but continuously flowing gas. The compact was placed in the retort and the retort was purged first with nitrogen gas and then with hydrogen gas. The hydrogen-filled retort was positioned within a furnace in a low heat zone maintained at about 500° C. to burn off the lubricant before sintering. Thereafter, the retort was moved into the furnace high heat zone maintained at the desired sintering temperature between about 950° to about 1120° C. The compact was sintered for one-half hour at the elevated temperature, while continuing hydrogen flow through the retort to maintain the desired reducing atmosphere. After sintering, the retort was removed from the furnace, purged with nitrogen gas and allowed to cool, before opening to remove the finished article.

Electron microscopic examination of the sintered powder structure revealed that the surfaces of pores therein were covered with a thin copper-base film. This film advantageously thickens the necks between the iron particles to improve the sintered properties. Microdistribution of the copper and phosphorus was determined with an electron microprobe. The phosphorus concentration was substantially uniform throughout the bulk of the iron, but was lower near the grain boundaries. Although most of the copper remained in the film on the pore surfaces, a small portion of the copper had diffused into the iron particles, principally along the grain boundaries, and formed an intergranular precipitate believed to be fcc ε-Cu phase. The phosphorus appeared to be principally in solid solution with the iron ferrite phase, but also formed a finely divided precipitate dispersed within the iron grains. The precipitate is believed to be $Fe_3P$ and displayed a bimodal orientation and a lenticular morphology, 200 um in diameter, 50 um in thickness.

The strength and ductility of the sintered bars were measured as tensile yield strength and total elongation, respectively, and the results are reported in Table I. The flat unmachined tension test bar was generally of the flat dumbell-shape recommended for ASTM Standard E8, but of slightly different dimensions. The test bar was 83 mm in length and was generally longitudinally divided into two end grip sections 26 mm in length and a central reduced section 31 mm in length. The width was 10 mm at the center and 13.5 mm at the end sections. The border on the side of the bar between the reduced section and the end sections was concave with a radius of 6 mm. The thickness was uniform for a particular bar and was between 2.3 to 3.0 mm. For testing, the bar was gripped by the end sections in a mechanical tensile test machine and pulled at a crosshead speed of 0.5 mm/sec, in accordance with the typical practice. Elongation was measured to the ultimate tensile strength using a spring-loaded high-gain extensometer with a 25 mm gauge length. Tensile yield strength was determined using a 0.2% offset. Despite the difference in bar dimensions, the test results are believed to be substantially equivalent to results obtained in accordance with ASTM Standard E8.

TABLE I

EFFECT OF $Cu_3P$ POWDER ADDITION AND SINTERING TEMPERATURE ON MECHANICAL PROPERTIES

| $Cu_3P$ Concentration In Weight Percent | Product P Concentration In Weight Percent | Sintering Temperature In °C. | Tensile Yield Strength In MPa | % Total Elongation |
|---|---|---|---|---|
| 4.9 | 0.7 | 1120 | 425 | 2.7 |
| 4.9 | 0.7 | 1050 | 408 | 2.2 |
| 3.5 | 0.5 | 1120 | 350 | 4.5 |
| 3.5 | 0.5 | 1050 | 332 | 3.9 |
| 3.5 | 0.5 | 1000 | 321 | 3.7 |
| 2.1 | 0.3 | 1120 | 260 | 6.2 |
| 2.1 | 0.3 | 1050 | 230 | 5.0 |
| 2.1 | 0.3 | 1000 | 220 | 4.5 |
| 2.1 | 0.3 | 970 | 198 | 3.5 |
| 0 | <0.01 | 1120 | 128 | 8.5 |
| 0 | <0.01 | 1050 | 122 | 7.0 |
| 0 | <0.01 | 1000 | 120 | 5.0 |

Also included in Table I are the mechanical properties for bar prepared with the plain iron powder alone. In comparison to the plain iron properties, the addition of copper phosphide powder to the compact substantially improves the tensile strength of the product, but reduces elongation. The increase in strength and the decrease in elongation are directly related to the $Cu_3P$ addition and the resulting overall phosphorus concentration. This is readily seen when comparing products prepared at equivalent sintering temperatures. In addition, the strength and elongation are directly related to the sintering temperature, with the higher temperatures generally providing the optimum properties.

Additional data showing the improved mechanical properties produced with the $Cu_3P$ powder are presented in Table II. The mechanical properties of test bars containing about 0.3 weight percent phosphorus added as $Cu_3P$ powder were compared to similar bars formed of iron powder, both alone and comprising a comparable 0.3 weight percent phosphorus added as iron phosphide $Fe_3P$ powder. For equivalent sintering temperatures between about 950° C. to about 1100° C., the copper phosphide produced substantially better yield strengths than either the iron or the phosphide-strengthened iron. For equivalent sintering temperatures, the iron product is more ductile than either phosphide-containing products. However, the copper phosphide addition of this invention produced elongations that were at least comparable to those produced by iron phosphide over the entire temperature range and were significantly better for sintering temperatures between about 1000° to about 1050° C.

TABLE II

COMPARISON OF MECHANICAL PROPERTIES FOR IRON, IRON PLUS $Fe_3P$ POWDER AND IRON PLUS $Cu_3P$ POWDER

| | Iron | | Iron Plus 1.75% $Fe_3P$ | | Iron Plus 2.17% $Cu_3P$ | |
|---|---|---|---|---|---|---|
| Sintering Temperature | Tensile Yield Strength In MPa | % Total Elongation | Tensile Yield Strength In MPa | % Total Elongation | Tensile Yield Strength In MPa | % Total Elongation |
| 950 | 118 | 5.0 | 136 | 1.8 | 136 | 1.6 |
| 970 | 120 | 5.1 | 173 | 2.3 | 190 | 2.3 |
| 1000 | 121 | 5.6 | 146 | 3.0 | 220 | 4.0 |
| 1050 | 122 | 7.0 | 152 | 4.3 | 228 | 4.9 |
| 1100 | 124 | 7.6 | 210 | 6.2 | 270 | 5.9 |

From the data in Table II, it is clearly seen that, at a specific sintering temperature, the combined mechanical properties that result from copper phosphide addition are generally superior to those of the other products. $Cu_3P$-formed products display substantially improved strength over iron alone. They also provide improved strength and generally improved ductility when compared to comparable phosphide-strengthened products. In addition, the method of this invention enables products having acceptable mechanical properties to be manufactured at significantly lower sintering temperatures. Powder compacts containing iron phosphide powder must be sintered at about 1100° C. to obtain adequate yield strengths greater than about 200 MPa. In contrast, powder compacts containing copper phosphide powder obtain yield strengths greater than about 200 MPa at about 1000° C., or about 100° lower than the comparable phosphide-strengthened product. As mentioned hereinabove, it is estimated that a reduction of 100° in the sintering temperature substantially reduces energy furnace maintenance costs.

In the preferred embodiment, the article was formed from a powder mixture containing between about 2 to about 5 weight percent powdered intermetallic copper phosphide compound $Cu_3P$. Higher phosphide concentrations greater than about 1% in the iron cause the sintered article to become too brittle and thus not useful. Thus, suitable powdered mixtures contain about 7.0 weight percent or less of the preferred $Cu_3P$ powder. Powder mixtures containing less than about 2.0 percent $Cu_3P$ powder do not produce sufficient copper-rich liquid to suitably coat the pores in the product and also provide insufficient phosphorus to strengthen the ferrite as desired.

When heated in the presence of iron, $Cu_3P$ forms a liquid at temperatures lower than its melting point of about 1014° C. For example, when heated at 10° C. per minute with about 5% iron powder, liquid forms at temperatures as low as 940° C. Liquid formation is theorized to occur as a result of solid state diffusion of phosphorus from the copper-base particles into the iron. This results in a localized shift of the copper phosphorus composition toward the eutectic. The resulting liquid wets the iron particle surface. After the copper phosphide has entirely liquified, continued phosphorus diffusion into the iron reduces the phosphorus concentration in the liquid, until eventually the phosphorus concentration in the liquid falls below the eutectic value of 8.4 percent and the solidus temperature of the composition begins rising. When the phosphorus content becomes sufficiently low, the solidus temperature rises above the sintering temperature and the copper-rich layer solidifies. Solidification of the copper layer, particularly at points where sharp cusps on adjacent particles touch, strengthens the product and improves ductility. It is believed that the formation of the transient liquid phase during sintering and its solidification at the sintering temperature have a significant role in improving the mechanical properties at the lower sintering temperature.

The preferred copper phosphorus composition is the intermetallic compound $Cu_3P$. During sintering, this compound gradually liquifies and forms a liquid that remains for a sufficient period of time to flow and wet the iron surfaces. Compositions having a phosphorus content equal to or less than the eutectic 8.4 weight percent do not form the transient liquid long enough to wet the iron surface and strengthen the product, especially at sintering temperatures less than the copper melting point of about 1084° C. It has been found that articles having equivalent phosphorus content, but formed using a powder comprising 6.8 weight percent phosphorus, produces inferior mechanical properties including about 13% lower strength and about 60% lower ductility at sintering temperatures less than about 1050° C. Therefore, suitable copper phosphorus powders for use in this invention have phosphorus concentrations greater than the eutectic and preferably are hypereutectic compositions comprising 12 weight percent or greater phosphorus. In the preferred embodiment, the powder was predominately $Cu_3P$, but had an overall composition slightly richer in phosphorus. Copper phosphorus compositions containing substantially more phosphorus than the intermetallic $Cu_3P$ compound decompose upon heating to form phosphorus vapors and $Cu_3P$ compound and may be suitable, but are obviously less preferred.

The preferred powder compacts are predominately formed of plain iron powder, that is, iron powders have low carbon contents, preferably less than about 0.15 weight percent. It is believed that phosphorus diffusion into brittle white iron having a high carbon content, for example 4 to 6%, tends to liquify the iron as a result of the iron-carbon-phosphorus tertiary eutectic and thus interferes with the desired copper-base liquid formation.

Although in the preferred embodiment, the compact was formed of −60 mesh iron powder and −325 mesh copper phosphide powder, it is apparent that other sizes may be suitably employed. It has been found that the use of finer copper phosphide powder generally improves the resulting mechanical properties. It is also apparent that other reducing atmospheres may be suitably substituted for the hydrogen atmosphere in the preferred sintering operation. In addition, sintering may be carried out in an endothermic-base atmosphere of the type formed by the combustion of a rich natural gas-air mixture to improve product strength. Furthermore, a restrike operation performed on the sintered product has also been found to substantially improve strength.

For example, an article formed from a mixture comprising 3.5 weight percent of the preferred $Cu_3P$ powder of −325 mesh and sintered at 1050° C. displays a tensile yield strength of 332 MPa and 3.9% total elongation, as presented in Table I. A similar article was prepared except that the copper phosphide powder was sized to −400 mesh instead of −325 mesh before mixing with the −60 mesh iron powder. The resulting sintered product had a tensile yield strength of 385 MPa and 4.2% total elongation. Thus, the sintered strength was substantially improved and the elongation was slightly improved by utilizing a finer copper phosphide powder. Another test bar was produced similarly, but sintered in a slightly carburizing endothermic-base atmosphere comprising 19.4% carbon monoxide, 39.7% nitrogen, 39.1% hydrogen, 0.82% carbon dioxide, 0.01% methane, and about 1% water. This test bar exhibited a tensile yield strength of about 462 MPa, which was greater than the hydrogen sintered bar. However, total elongation was slightly reduced to about 2.8%. Another test bar was prepared as in the preferred embodiment and, after sintering, subjected to a restrike carried out in the compacting die to effect a 1% decrease in volume. After the restrike, the test bar exhibited a tensile yield strength of 418 MPa and a total elongation of 3.8%. Thus, the restrike produced a substantial increase in the product strength, but did not significantly affect ductility.

While this invention has been described in terms of certain specific embodiments thereof, it will be appreciated that other forms can readily be adapted by those skilled in the art, and, accordingly, the scope of this invention is to be considered limited only by the following claims.

The embodiments of the invention in which an exclusive property or privilege is claimed are defined as follows:

1. A method for forming an article from iron powder comprising compacting a powder mixture comprising plain iron particles and a hypereutectic copper phosphorus sintering agent, and sintering the compact at a temperature between about 950° C. and 1120° C. to cause the copper phosphorus agent to form a liquid capable of wetting the surface of the iron particles, said sintering being carried out for a time sufficient for phosphorus to diffuse into the iron particles and for the remaining copper-enriched liquid to flow and wet iron surfaces in the compact and thereafter form a solidified copper-rich layer on pore surfaces within the product sintered article.

2. A method for forming an article from iron powder metal comprising compacting a powder mixture comprising a major portion of iron particles and up to about 7 weight percent of hypereutectic copper-phosphorus particles containing at least 12 weight percent phosphorus, and sintering the compact at a temperature between about 950° C. and about 1120° C. for a sufficient time to cause phosphorus to diffuse uniformly throughout the iron particles and to form a copper-enriched liquid that coats pore surfaces in the compact and, upon solidification, forms a copper-rich film on pore surfaces within the sintered article, whereby said sintering produces an improved combination of ductility and strength in the product article.

3. A method for forming an article from powder metal comprising compacting a powder mixture comprising a major portion of low-carbon iron particles and between about 2 to about 5 weight percent of hypereutectic tricopper phosphide $Cu_3P$ compound powder, and sintering the compact at a temperature between about 970° C. to 1100° C. for a sufficient time to cause the $Cu_3P$ powder to form a liquid that wets the iron powder surfaces, a major portion of the phosphorus diffusing during said sintering into the iron particles, the remaining copper-enriched liquid forming a coating on pore surfaces in the product article, whereby the sintered article displays an improved combination of ductility and strength.

4. A method for forming an article from powder metal comprising sintering a compact formed of a powder mixture comprising a major portion of plain iron particles and a hypereutectic copper phosphorus sintering agent, said sintering being carried out at a temperature and for a time suitable for diffusing phosphorus substantially uniformly throughout the iron and for forming a transient copper-base liquid phase that wets iron surfaces in the compact, said sintering continuing for a time sufficient to deplete phosphorus from the liquid phase to a concentration whereat said phase solidifies, thereby forming a copper-rich film that coats pore surfaces in the article.

5. A method for forming an article from powder metal comprising compacting a powder mixture comprising a major portion of plain iron particles and up to about 7 weight percent of tricopper phosphide compound powder, and sintering the compact at a suitable temperature above about 950° C. to diffuse phosphorus from the phosphide powder into the iron and to form a transient copper-rich liquid that wets iron surfaces in the compact, said sintering continuing for a time sufficient to diffuse phosphorus substantially uniformly throughout the iron and to deplete phosphorus from the liquid to a suitably low concentration whereat the liquid solidifies at the sintering temperature to form a copper-rich coating on pore surfaces in the product sintered article.

* * * * *